US009051656B2

(12) United States Patent
Bhavaraju et al.

(10) Patent No.: US 9,051,656 B2
(45) **Date of Patent: *Jun. 9, 2015**

(54) ELECTROCHEMICAL SYNTHESIS OF ARYL-ALKYL SURFACANT PRECURSOR

(75) Inventors: Sai Bhavaraju, West Jordan, UT (US); Mukund Karanjikar, West Valley City, UT (US); Pallavi Chitta, West Valley City, UT (US)

(73) Assignee: CERAMATEC, INC., Salt Lake City, UT (US)

( * ) Notice: Subject to any disclaimer, the term of this patent is extended or adjusted under 35 U.S.C. 154(b) by 851 days.

This patent is subject to a terminal disclaimer.

(21) Appl. No.: 13/092,685

(22) Filed: Apr. 22, 2011

(65) Prior Publication Data

US 2011/0226633 A1 Sep. 22, 2011

Related U.S. Application Data

(63) Continuation-in-part of application No. 12/840,401, filed on Jul. 21, 2010.

(60) Provisional application No. 61/327,477, filed on Apr. 23, 2010, provisional application No. 61/353,724, (Continued)

(51) Int. Cl.
*C25B 3/00* (2006.01)
*C25B 1/16* (2006.01)
(Continued)

(52) U.S. Cl.
CPC .... *C25B 3/10* (2013.01); *C25B 9/08* (2013.01)

(58) Field of Classification Search
CPC ..... C25B 3/00; C25B 3/02; C25B 3/10; C25B 3/12; C25B 9/08
USPC ..... 205/413, 462, 440, 464, 477, 508, 510
See application file for complete search history.

(56) References Cited

U.S. PATENT DOCUMENTS 2,760,926 A 8/1956 Kronenthal
2,867,569 A * 1/1959 Kronenthal ..... 205/452
(Continued)

FOREIGN PATENT DOCUMENTS

CN 101089231 A 12/2007
CN 101336313 A 12/2008
(Continued)

OTHER PUBLICATIONS

Chem AP 2 (2003).*
(Continued)

*Primary Examiner* — Luan Van
*Assistant Examiner* — Alexander W Keeling
(74) *Attorney, Agent, or Firm* — David Fonda

(57) ABSTRACT

An aryl-alkyl (R—Ar) hydrocarbon is prepared by an electrosynthesis process in an electrolytic cell having an alkali ion conductive membrane positioned between an anolyte compartment configured with an anode and a catholyte compartment configured with a cathode. An anolyte solution containing an alkali metal salt of an alkyl carboxylic acid and an aryl compound is introduced into the anolyte compartment. The aryl compound may include an alkali metal salt of an aryl carboxylic acid, an arene (aromatic) hydrocarbon, or an aryl alkali metal adduct ($Ar^-M^+$). The anolyte solution undergoes electrolytic decarboxylation to form an alkyl radical. The alkyl radical reacts with the aryl compound to produce the aryl-alkyl hydrocarbon.

26 Claims, 6 Drawing Sheets

Related U.S. Application Data filed on Jun. 11, 2010, provisional application No. 61/288,078, filed on Jul. 23, 2009, provisional application No. 61/258,557, filed on Nov. 5, 2009, provisional application No. 61/260,961, filed on Nov. 13, 2009.

(51) Int. Cl.
*C25B 3/10* (2006.01)
*C25B 9/08* (2006.01)

(56) References Cited

U.S. PATENT DOCUMENTS

| | | | | |
|---|---|---|---|---|
| 3,193,479 | A | 7/1965 | Baizer | |
| 3,249,521 | A | 5/1966 | Baizer | |
| 3,885,626 | A * | 5/1975 | Gale et al. | 166/270.1 |
| 3,992,471 | A | 11/1976 | Priegnitz | |
| 4,006,065 | A | 2/1977 | Meresz et al. | |
| 4,123,336 | A | 10/1978 | Seko et al. | |
| 4,402,804 | A | 9/1983 | Jackson | |
| 4,464,236 | A | 8/1984 | Noding | |
| 5,084,146 | A | 1/1992 | Huang | |
| 5,290,404 | A * | 3/1994 | Toomey | 205/450 |
| 5,290,405 | A * | 3/1994 | Joshi et al. | 205/338 |
| 5,580,430 | A | 12/1996 | Balagopal et al. | |
| 5,633,400 | A | 5/1997 | Wagner et al. | |
| 5,841,002 | A * | 11/1998 | Harrison et al. | 568/853 |
| 5,892,107 | A | 4/1999 | Farone et al. | |
| 6,193,872 | B1 | 2/2001 | Reason et al. | |
| 6,238,543 | B1 * | 5/2001 | Law et al. | 205/415 |
| 6,362,380 | B1 | 3/2002 | Eicken et al. | |
| 6,392,091 | B2 | 5/2002 | Lin | |
| 8,506,789 | B2 | 8/2013 | Bhavaraju et al. | |
| 2001/0019020 | A1 | 9/2001 | Merk et al. | |
| 2005/0177008 | A1 | 8/2005 | Balagopal et al. | |
| 2008/0177114 | A1 | 7/2008 | Goossen et al. | |
| 2008/0245671 | A1 | 10/2008 | Balagopal et al. | |
| 2009/0074611 | A1 | 3/2009 | Monzyk et al. | |
| 2009/0305942 | A1 | 12/2009 | Day et al. | |
| 2010/0331170 | A1 | 12/2010 | Balagopal et al. | |
| 2011/0024288 | A1 | 2/2011 | Bhavaraju et al. | |
| 2011/0027848 | A1 | 2/2011 | Karanjikar et al. | |
| 2011/0035995 | A1 | 2/2011 | Williams | |
| 2011/0111475 | A1 * | 5/2011 | Kuhry et al. | 435/166 |
| 2011/0168569 | A1 | 7/2011 | Bhavaraju et al. | |
| 2011/0226633 | A1 | 9/2011 | Bhavaraju et al. | |
| 2011/0240484 | A1 | 10/2011 | Pendleton et al. | |
| 2012/0035403 | A1 | 2/2012 | Flytzani-Stephanopoulos et al. | |
| 2012/0142945 | A1 | 6/2012 | Hwang et al. | |
| 2012/0316093 | A1 | 12/2012 | Zhan et al. | |
| 2013/0001095 | A1 | 1/2013 | Bhavaraju et al. | |
| 2013/0186770 | A1 | 7/2013 | Mosby et al. | |
| 2013/0284607 | A1 * | 10/2013 | Bhavaraju et al. | 205/440 |
| 2014/0154766 | A1 | 6/2014 | Karanjikar et al. | |

FOREIGN PATENT DOCUMENTS

| | | |
|---|---|---|
| EP | 0838435 | 4/1998 |
| GB | 787976 | 12/1957 |
| JP | 06271499 | 9/1994 |
| SU | 979325 | 12/1982 |
| WO | WO-2007/095215 | 8/2007 |
| WO | WO 2012103529 | 8/2012 |

OTHER PUBLICATIONS

Mendez, Zulmariam "Non-Final Office Action", U.S. Appl. No. 13/790,744, (Mar. 20, 2014),1-22.

Mendez, Zulmariam "Final Office Action", U.S. Appl. No. 12/840,401, (Mar. 13, 2014),1-23.

Wong, Edna "Non-Final Office Action", U.S. Appl. No. 13/612,192, (Apr. 8, 2014),1-24.

Wong, Edna "Non Final Office Action", U.S. Appl. No. 12/840,913, Mar. 28, 2013,1-31.

Sekine, Isao et al., "Effect of the Concentration of Acetate or Propionate on the Abnormal Phenomena in the Kolbe Reaction", *Denki Kagaku*, vol. 41(9), (1973),702-707.

Wong, Edna "Non Final Office Action", U.S. Appl. No. 13/357,463, (Apr. 9, 2013),1-21.

Palit, Santi R., "The Solubility of Soaps and of Some Salts in Mixtures of Solvents, One of Which Is of Glycolic Type", *Utah Consortia UALC*, vol. 69, (Dec. 1947),3120-29.

Park, Sang Ho "PCT International Search Report", Int. App. No. PCT/US2010/042715, (Apr. 29, 2011),1-3.

Park, Sang Ho "PCT Written Opinion", Int. App. No. PCT/US2010/042715, (Apr. 29, 2011),1-4.

Kang, Sang Yoon "PCT International Search Report", Int. App. No. PCT/US2010/042756, (Feb. 28, 2011),1-3.

Kang, Sang Yoon "PCT Written Opinion", Int. App. No. PCT/US2010/042756, (Feb. 28, 2011),1-4.

Park, Sang Ho "PCT International Search Report", Int. App. No. PCT/US2010/042780, (May 2, 2011),1-3.

Park, Sang Ho "PCT Written Opinion", Int. App. No. PCT/US2010/042780, (May 2, 2011),1-4.

Bozell, Joseph J., "Connecting Biomass and Petroleum Processing with a Chemical Bridge", *Science*, (Jul. 30, 2010),vol. 329: 522-523.

Bond, Jesse Q., et al., "Integrated Catalytic Conversion of gamma-Valerolactone of Liquid Alkenes for Transportation Fuels", *Science*, (Feb. 26, 2010),vol. 327: 1110-1114.

Chum, H L., et al., "Photoelectrochemistry of Levulinic Acid on Undoped Platinized n-TIO2 Powders", *J. Phys. Chem*, (1983),vol. 87: 3089-3093.

Schafer, Hans-Jurgen "Recent Contributions of Kolbe Electrolysis to Organic Synthesis", *Topics in Current Chemistry*, (1990),vol. 152: 91-151.

Rabjohn, et al., "Kolbe Electrosynthesis of Alkanes with Multiple Quaternary Carbon Atoms", *J. Org. Chem.*, (1981),vol. 46, pp. 4082-4083.

Wong, Edna "USPTO Office Action", U.S. Appl. No. 12/840,508, (Nov. 2, 2011),17 pages.

Kobzeva, et al., "Effect of a solvent on anode processes", *Elektrokhimiya*, vol. 11. No. 5, (1975),1 page abstract.

Ono, et al., "Electrolysis of fatty acids I", *Ind. Chem. Sect. 53*, (1950),1 page abstract.

Minami, et al., "Electrolysis of Fatty Acids II", *Kogyo Kagaku Zasshi*, vol. 53, (1950),1 page abstract.

Obermuller, "Saponification by Sodium Ethoxide", *J Chem. Soc.*, Abstr. 62, (1892),1 page abstract.

Wong, Edna "USPTO Office Action", U.S. Appl. No. 12/840,913, (Nov. 16, 2011),16 pages.

Wong, Edna "Non-Final Office Action", U.S. Appl. No. 12/840,508, (Apr. 26, 2012),1-32.

Wong, Edna "Non-Final Office Action", U.S. Appl. No. 12/840,913, (Apr. 10, 2012),1-12.

Mendez, Zulmariam "Non-Final Office Action", U.S. Appl. No. 12/840,401, (Jun. 5, 2012),1-12.

Wong, Edna "Non-Final Office Action", U.S. Appl. No. 13/357,463, (Jun. 4, 2012),1-25.

Pande, et al., "Studies on Kolbe's Electrosynthesis", *Electrochimica Acta*, Aug. 1961, vol. 4, (Aug. 1961),215-231.

Ho, Park S., "International Search Report", PCT US 2011/035782 (corresponding to U.S. Appl. No. 13/103,716, (Feb. 9, 2012),1-3.

Ho, Park S., "Written Opinion of the International Searching Authority", PCT US 2011/035782 (corresponding to U.S. Appl. No. 13/103,716, (Feb. 9, 2012),1-4.

Ko, et al., "Computer Translation of the Detailed Description of JP 6-271499", Japanese Patent publication 06-271499, (Sep. 27, 1994),1-8.

Aslanov, N. N. "English Language Bibliographical Information and Abstract", SU Patent No. 979325, (Dec. 7, 1982),1-3.

Choi, et al., "Recovery of lactic acid from sodium lactate by ion substitution using ion-exchange membrane", *Separation and Purification Technology 28* (2002), Elsevier, (Mar. 4, 2002),69-79.

Habova, et al., "Application of Electrodialysis for Lactic Acid Recovery", *Czech. J. Food Sci.*, vol. 19, No. 2 (2001), (Jan. 1, 2001),73-80.

(56) References Cited

OTHER PUBLICATIONS

Huang, et al., "Application of electrodialysis to the production of organic acids: State-of-the-art and recent developments", *Journal of Membrane Science 288* (2007), Elsevier, (Nov. 25, 2006),1-12.
Lu, et al., "Modeling of the mass transfer and conduction behavior in electro-electrodialysis with oil/water emulsion as the catholyte", *Journal of Membrane Science* 322 (2008), (Jun. 5, 2008),265-274.
Moon, et al., "Competitive Anion Transport in Desalting Mixtures of Organic Acids by Batch Electrodialysis", *Journal of Membrane Science* 141 (1998), Elsevier, (Apr. 1, 1998),75-89.
Palaty, et al., "Continuous dialysis of carboxylic acids. Permeability of Neosepta-AMH membrane", *Desalination* 216 (2007), Elsevier, (Oct. 1, 2007),345-355.
Prado Rubio, et al., "Modeling Reverse Electro-Enhanced Dialysis for Integration with Lactic Acid Fermentation", *CAPEC, Department of Chemical and Biochemical Engineering Technical University of Denmark (DTU)*, DK-2800 Lyngby, Denmark, 2009, Available as "A-DK-Prado Rubio-OA-1" at Docstoc.com, http://www.docstoc.com/search/modeling%20reverse%020electro~enhanced%-20dialysis%20for%20integration%20with%20lactic%20acid%20-fermentation?catid=0,(Jan. 1, 2009),1-2.
Yi, et al., "An in situ coupling separation process of electro-electrodialysis with back-extraction", *Journal of Membrane Science* 255 (2005), Elsevier, (Mar. 21, 2005),57-65.
Park, Sang H., "International Search Report", PCT Application No. PCT/US2011/033626 (corresponding to U.S. Appl. No. 13/092,685, (Feb. 8, 2012),1-3.
Park, Sang H., "Written Opinion of the International Searching Authority", PCT Application No. PCT/US2011/033626 (corresponding to U.S. Appl. No. 13/092,685, (Feb. 8, 2012),1-4.
Paul, et al., "Reactions of Sodium Metal with Aromatic Hydrocarbons", *J. Am. Chem. Soc.*, 1956, 78 (1), (Jan. 1956),116-120.
Mendez, Zulmariam "Non Final Office Action", U.S. Appl. No. 12/840,401, (Jul. 30, 2013),1-15.
Wong, Edna "Final Office Action", U.S. Appl. No. 12/840,913, (Jul. 18, 2013),1-16.
Wong, Edna "Notice of Allowance", U.S. Appl. No. 12/840,508, (Apr. 29, 2013),1-11.
Conway, et al., "New Approaches to the Study of Electrochemical Decarboxylation and the Kolbe Reaction. I. The Model Reaction with Formate", *Canadian Journal of Chemistry* (no month, 1963), vol. 41, (1963),21-37.
Wong, Edna "Final Office Action", U.S. Appl. No. 12/840,913, (Aug. 14, 2012),1-28.
Wong, Edna "Final Office Action", U.S. Appl. No. 12/840,508, (Nov. 27, 2012),1-25.
Wong, Edna "Final Office Action", U.S. Appl. No. 13/357,463, (Sep. 19, 2012),1-17..
Dzik, et al., "Carboxylates as sources of carbon nucleophiles and electrophiles: comparison of decarboxylative and decarbonylative pathways", *Chemical Science*, 2012, vol. 3, Issue No. 9 (2012), (May 3, 2012),2671-78.
Mendez, Zulmariam "Final Office Action", U.S. Appl. No. 12/840,401, (Mar. 15, 2013),1-12.
Wong, Enda "Notice of Allowance", U.S. Appl. No. 12/840,913, (Oct. 4, 2013),1-11.
Wong, Edna "Final Office Action", U.S. Appl. No. 13/357,463, (Sep. 6, 2013),1-16.
Wong, Edna "Non-Final Office Action", U.S. Appl. No. 13/612,192, (Dec. 10, 2013),1-33.
Wong, Edna "Final Office Action", U.S. Appl. No. 13/357,463, (Jan. 3, 2014),1-14.
Stapley, et al., "English Language Abstract", CN101336313A, (Dec. 31, 2008),1.
Hongyou, et al., "English Language Abstract", CN101089231A, (Dec. 19, 2007),1.
Le, Zhikang "Chinese Office Action", Chinese Application No. 201080024541.8, (Jan. 21, 2014),1-10.
Kim, Su M., "International Search Report", PCT Application No. PCT/US2014/020786 (Corresponding to U.S. Appl. No. 14/198,026), (Jun. 26, 2014),1-3.
Kim, Su M., "Written Opinion of the International Searching Authority", PCT Application No. PCT/US2014/020786 (Corresponding to U.S. Appl. No. 14/198,026), (Jun. 26, 2014),1-3.
Mendez, Zulmariam "Non-Final Office Action", U.S. Appl. No. 12/840,401, (Aug. 26, 2014),1-18.
Wong, Edna "Final Office Action", U.S. Appl. No. 13/612,192, (Aug. 15, 2014),1-18.
Wong, Edna "Non-Final Office Action", U.S. Appl. No. 13/930,211, (Jul. 23, 2014),1-43.
Klocke, et al., "Influences on the Selectivity of the Kolbe versus the Non-Kolbe Electrolyis in the Anodic Decarboxylation of Carboxylic Acids", *Electroorganic Sythesis*, (Nov. 2, 1992),1-8.
Shin, Ju C., "International Search Report", PCT Application No. PCT/US2014/028842 (Corresponding to U.S. Appl. No. 13/834,569, (Aug. 14, 2014),1-3.
Shin, Ju C., "Written Opinion of the International Searching Authority", PCT Application No. PCT/US2014/028842 (Corresponding to U.S. Appl. No. 13/834,569), (Aug. 14, 2014),1-7.
Shin, Ju C., "International Search Report", PCT/US2014/021927 (Corresponding to U.S. Appl. No. 13/790,744), (Jul. 10, 2014),1-3.
Shin, Ju C., "Written Opinion of the International Searching Authority", PCT/US2014/021927 (Corresponding to U.S. Appl. No. 13/790,744), (Jul. 10, 2014),1-7.
Wong, Edna "Non-Final Office Action", U.S. Appl. No. 13/103,716, (Jun. 24, 2014),1-15.
Wong, Edna "Non-Final Office Action", U.S. Appl. No. 13/612,192, (Dec. 5, 2014),1-37.
Glasstone, et al., "Studies in Electrolysis Oxydation Part V11. The Electrolysis of Acetates in Non-Aqueous Solutions.", *J. Chem. Soc.*, (Jan. 1, 1936),820-827.
Wong, Edna "Final Office Action", U.S. Appl. No. 13/930,211, (Nov. 21, 2014),1-32.
Wong, Edna "Final Office Action", U.S. Appl. No. 13/103,716, (Nov. 20, 2014),1-15.
Wong, Edna "Non-Final Office Action", U.S. Appl. No. 14/198,026, (Nov. 14, 2014),1-20.
Mendez, Zulmariam "Non-Final Office Action", U.S. Appl. No. 13/790,744, (Nov. 4, 2014),1-11.

* cited by examiner

ELECTROCHEMICAL SYNTHESIS OF ARYL-ALKYL SURFACANT PRECURSOR

CROSS-REFERENCE TO RELATED APPLICATIONS

This application claims the benefit of U.S. Provisional Application No. 61/327,477, filed Apr. 23, 2010 and U.S. Provisional Application No. 61/353,724, filed Jun. 11, 2010. This application is a continuation-in-part of U.S. application Ser. No. 12/840,401, filed Jul. 21, 2010, which application claims the benefit of U.S. Provisional Application No. 61/228,078, filed Jul. 23, 2009, U.S. Provisional Application No. 61/258,557, filed Nov. 5, 2009, and U.S. Provisional Application No. 61/260,961, filed on Nov. 13, 2009. These non-provisional and provisional patent applications are expressly incorporated herein by reference.

BACKGROUND

The present invention describes a method for the manufacture of aryl-alkyl surfactant precursors from inexpensive starting materials. The invention utilizes an electrolytic decarboxylation process (EDP) to perform the reaction at low temperature without the use of catalysts. The general surfactants manufactured will potentially be used by companies involved with Enhanced Oil Recovery (EOR), synthetic motor oil, flocculation, mining, paints, coatings, adhesives, industrial applications under extreme conditions of pH and temperature just to mention a few.

More than 50 million pounds of aryl-alkyl sulfonic acid surfactants are widely used for Enhanced Oil Recovery (EOR) and other industrial applications, but they are expensive to manufacture by a traditional process shown below:

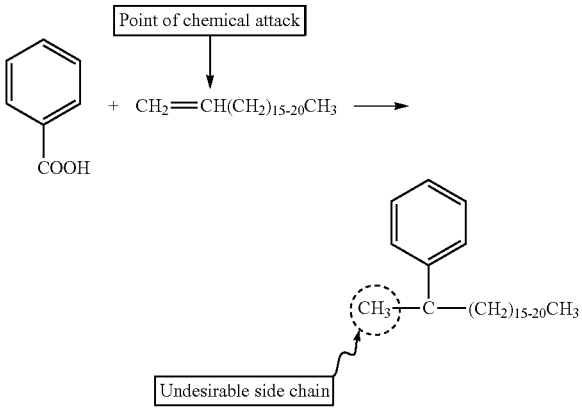

As shown above, the current process involves using long chain alpha-alkenes that are expensive, currently ~$6/gallon, to react with benzene ring in the presence of a catalyst. In the above process, the beta carbon of the long chain alpha-alkene is reactive, resulting is a product having an undesirable methyl side chain.

It would be an advancement in the art to prepare aryl-alkyl surfactant precursors using lower cost starting materials compared to alpha-alkenes. It would also be an advancement in the art to prepare aryl-alkyl surfactant precursors in a process that avoids the producing products having undesirable side chains.

SUMMARY OF THE INVENTION

The present invention describes a method for the manufacture of aryl-alkyl surfactant precursor from inexpensive starting materials. According to the presently discussed method, aryl-alkyl surfactant precursors are manufactured using lower cost ($1.50/gallon) fatty acids instead of alpha-alkenes. Also the invention describes an electrolytic decarboxylation process (EDP) to perform the reaction at low temperature and low pressure without the use of catalysts. The EDP process using a divided or undivided cell may offer a way to reduce their cost of manufacture. The general surfactants manufactured will potentially be used by companies involved with EOR, synthetic motor oil, flocculation, mining, paints, coatings, adhesives, industrial applications under extreme conditions of pH and temperature just to mention a few.

One Electrolytic Decarboxylation Process is disclosed in U.S. Patent Application Publication No. 20110024288, which is incorporated herein by reference.

The invention relates to the conversion of mixture of arenes (aromatic or aryl hydrocarbons) or alkali aryl carboxylates and fatty acid alkali salt starting materials into aryl-alkyl hydrocarbons by electrolytic method. The starting materials can be of plant, algal, or animal origin. The electrolysis cell deployed for this reaction utilizes a selective alkali ion transport membrane technology.

In a first disclosed method, a mixture of aryl carboxylic acid and alkyl carboxylic acids are converted to their respective alkali salts via an acid neutralization process. These alkali salts are then mixed with one or more appropriate solvents to yield a reacting mixture. The mixture is then converted to an aryl-alkyl hydrocarbon by electrolytic (anodic) decarboxylation of both the aryl carboxylate and the alkyl carboxylate and subsequent aryl-alkyl carbon-carbon coupling. The alkyl carboxylic acid is preferably a fatty acid.

In a second disclosed method, an arene and alkyl acid alkali salts are mixed with one or more appropriate solvents to yield a reacting mixture. Non-limiting examples of arene hydrocarbons include benzene, ethyl benzene, and naphthalene. The mixture is then converted to aryl-alkyl hydrocarbon by electrolytic (anodic) decarboxylation of the fatty acid carboxylate and subsequent aryl-alkyl carbon-carbon coupling.

In a third disclosed method, an arene hydrocarbon is reacted with an alkali metal to form an alkali metal-arene adduct ($Ar^-M^+$). The adduct is mixed with a fatty acid alkali salt in one or more appropriate solvents to yield a reacting mixture. The mixture is then converted to aryl-alkyl hydrocarbon by electrolytic (anodic) decarboxylation of fatty carboxylate and subsequent aryl-alkyl carbon-carbon coupling.

BRIEF DESCRIPTION OF THE SEVERAL DRAWINGS

Embodiments of the present invention will be best understood by reference to the enclosed drawings. It will be readily understood that the components of the present invention, as generally described and illustrated in the figures herein, could be arranged and designed in a wide variety of different configurations. Thus, the following more detailed description of the embodiments of the methods and cells of the present invention, as represented in FIGS. 1 and 2, and is not intended to limit the scope of the invention, as claimed, but is merely representative of presently preferred embodiments of the invention.

FIG. 1 discloses an electrolytic cell for electrosynthesis of aryl-alkyl hydrocarbons by anodic decarboxylation.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment. Additionally, while the following description refers to several embodiments and examples of the various components and aspects of the described invention, all of the described embodiments and examples are to be considered, in all respects, as illustrative only and not as being limiting in any manner.

Furthermore, the described features, structures, or characteristics of the invention may be combined in any suitable manner in one or more embodiments. In the following description, numerous specific details are disclosed to provide a thorough understanding of embodiments of the invention. One having ordinary skill in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
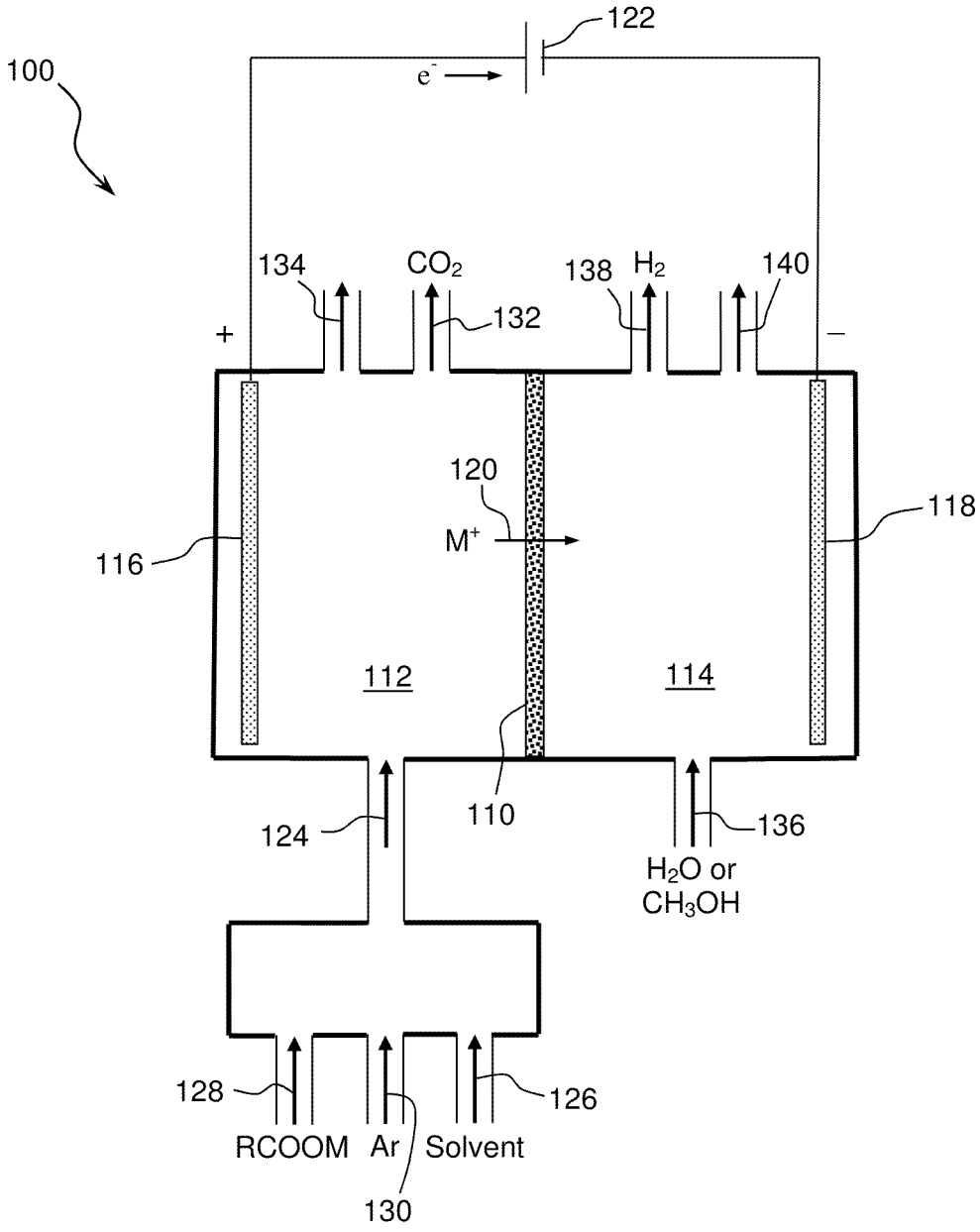

Referring now to FIG. 1, an electrolytic cell 100 according to one embodiment of the present invention is shown. The electrolytic cell 100 produces aryl-alkyl hydrocarbons by electrolytic (anodic) decarboxylation of alkyl carboxylic acids and subsequent aryl-alkyl carbon-carbon coupling. The disclosed process uses an alkali ion conductive membrane 110 that divides the electrochemical cell 100 into two compartments: an anolyte compartment 112 and a catholyte compartment 114. An electrochemically active anode 116 is housed in the anolyte compartment 112 where oxidation reactions take place. An electrochemically active cathode 118 is housed in the catholyte compartment 114 where reduction reactions take place. The alkali ion conductive membrane 110 selectively transfers alkali ions ($M^+$) 120, including but not limited to, sodium ions, lithium ions, and potassium ions, from the anolyte compartment 112 to the catholyte compartment 114 under the influence of an electrical potential 122 while preventing solvent or anion transportation from either compartment to the other side.

The alkali ion conductive membrane 110 can comprise virtually any suitable alkali ion conductive membrane that selectively conducts alkali ions and prevents the passage of water, hydroxide ions, or other reaction products. The alkali ion conducting membrane may comprise a ceramic, a polymer, or combinations thereof. In one non-limiting embodiment, the alkali ion conducting membrane comprises an alkali ion super ion conducting (MSICON) membrane. Some non-limiting examples of such membranes include, but are not limited to, a NaSICON (sodium super ionic conductor membrane) and a NaSICON-type membrane. The alkali ion conductive membrane may be any of a number of sodium super ion conducting materials, including, without limitation, those disclosed in United States Patent Application Publications Nos. 2010/0331170 and 2008/0245671 and in U.S. Pat. No. 5,580,430. The foregoing applications and patent are hereby incorporated by reference. Where other non-sodium alkali compounds are used within the scope of the present invention, it is to be understood that similar alkali ion conductive membranes such as a LiSICON membrane, a LiSICON-type membrane, a KSICON membrane, a KSICON-type membrane may be used. In some embodiments, an alkali ion conducting ion-exchange polymeric membrane may be used. In some embodiments, the alkali ion conducting membrane may comprise an alkali ion conductive glass or beta alumina.

In one embodiment, the alkali ion conductive membrane is between about 200 microns and about 2000 microns thick. In other embodiment, the membrane is between about 400 and 1000 microns thick. In one embodiment 3 inch diameter MSICON wafers are assembled in a scaffold.

The electrochemical cell 100 may be of standard parallel plate configuration where flat plate electrodes and membranes are used, such as shown in FIG. 1. It is within the level of skill in the art to configure the electrochemical cell in a tubular configuration where tubular electrodes and membranes are used.

The anode 116 can comprise any suitable anode material that allows oxidation (decarboxylation) reaction and subsequent free radical carbon-carbon coupling in the anolyte compartment when electrical potential passes between the anode and the cathode. Some non-limiting examples of suitable anode materials include, but are not limited to, smooth platinum, titanium, nickel, cobalt, iron, stainless steel, lead dioxide, metal alloys, combinations thereof, and other known or novel anode materials. In one embodiment, the anode 116 may comprise iron-nickel alloys such as KOVAR® or INVAR®. In other embodiments, the anode 116 may comprise carbon based electrodes such as boron doped diamond, glassy carbon, and synthetic carbon. Additionally, in some embodiments the anode 116 comprises a dimensionally stable anode (DSA), which may include, but is not limited to, rhenium dioxide and titanium dioxide on a titanium substrate, and rhenium dioxide and tantalum pentoxide on a titanium substrate.

The cathode 118 may also be fabricated of any suitable cathode that allows the cell to reduce water or methanol in the catholyte compartment to produce hydroxide ions or methoxide ions and hydrogen gas. The cathode 118 may comprise the materials used in the anode 116. Some non-limiting examples of suitable cathode materials include, without limitation, nickel, stainless steel, graphite, and any other suitable cathode material that is known or novel.

The electrolytic cell 100 is operated by feeding an anolyte solution 124 into the anolyte compartment 112. The anolyte solution 124 comprises a solvent 126, an alkali metal salt of an alkyl carboxylic acid 128, and an aryl compound 130. In some embodiments, the aryl compound may comprise an alkali metal salt of an aryl carboxylic acid. In some embodiments, the aryl compound may comprise an arene hydrocarbon. In some embodiments, the aryl compound may comprise an alkali metal-arene adduct ($Ar^-M^+$). The alkali metal-arene adduct is obtained by reacting an arene hydrocarbon with an alkali metal.

The anolyte solution 124 may comprise a mixture of solvents. The anolyte solution solvent may comprise a two-phase solvent system, wherein one phase is capable of dissolving ionic materials and the other phase is capable of dissolving non-ionic materials. For example, the solvent may comprise an organic phase solvent such as a non-ionic, non-aqueous solvent. Inorganic or other solvents may also be used. An example of such a solvent would be a long chain fatty acid alcohol, or other similar organic solvent. Mixed with this organic phase solvent is an ionic solvent or aqueous solvent, such as water or an ionic liquid. This water/ionic liquid dissolves the alkali metal salt of the fatty acid. Using this type of "two-phase" system, the aryl-alkyl hydrocarbon, when formed, will readily dissolve in the organic phase, and will be repelled by the aqueous/ionic phase. This means that the formed hydrocarbon(s) will readily separate from the aqueous/ionic phase.

In one embodiment, the anolyte comprises G-type solvents, H-Type solvents, and/or mixtures thereof. G-type solvents are di-hydroxyl compounds. In one embodiment the G-type compound comprises two hydroxyl groups in contiguous position. H-type solvents are hydrocarbon compounds or solvent which can dissolve hydrocarbons. For example, H-type solvents include, hydrocarbons, chlorinated hydrocarbons, alcohols, ketones, mono alcohols, and petroleum fractions such as hexane, gasoline, kerosene, dodecane, tetrolene, and the like. The H-type solvent can also be a product of the decarboxylation process recycled as a fraction of the hydrocarbon product. This will obviate the need of procuring additional solvents and hence improve overall economics of the process.

By way of further description, G-type of solvents solvate a —COONa group of a alkali metal salt of carboxylic acid by hydrogen bonding with two different oxygen atoms, whereas the hydrocarbon end of the alkali metal salt of carboxylic acid is solvated by an H-type of solvent. For a given G-type solvent, the solvency increases with increase of hydrocarbons in the H-type solvent.

Table 1, below, shows some non-limiting examples of G-type and H-type solvents:

TABLE 1

| G-type | H-type |
|---|---|
| ehthylene glycol | isopropanol |
| glycerine | methanol |
| 1,2-dihidroxy-4-oxadodecane | ethanol |
| 2-methyl-2-propyl-1,3-propanediol | butanol |
| 2-ethyl-1,3-hexanediol | amyl alcohol |
| 2-amino-2-methyl-1,3-propanediol | octanol |
| 2,3-butanediol | hexane |
| 3-amino-1,2-propanediol | trichloroethane, dichloroethane |
| 1,2-octanediol | methylene dichloride |
| cis-1,2-cyclohexanediol | chloroform |
| rans-1,2-cyclohexanediol | carbon tetrachloride |
| cis-1,2-cyclopentanediol | tetralin |
| 1,2-pentanediol | decalin |
| 1,2-hexanediol | monoglyme |
| | diglyme |
| | tetraglyme |
| | acetone |
| | acetaldehyde |

The solubility of various sodium salts of carboxylic acids were tested at room temperature in a magnetically stirred glass beaker using G-type solvents, H-type solvents, and combinations of G- and H-type solvents. The following tables show solubility test results for various salts.

TABLE 2A

Salt: Sodium Oleate

| Solvent/Co-solvents | Solubility | Solubility limit g/100 g |
|---|---|---|
| Ethylene glycol | ✓ | 36.00 |
| Ethylene glycol/Isopropanol (1.4:1) | ✓ | 57.90 |
| Ethylene glycol/Methanol (1.4:1) | ✓ | 31.25 |
| Ethylene glycol/Methanol (5.55:1) | ✓ | 9.56 |
| Methanol | ✓ | 16.60 |

TABLE 2B

Salt: Sodium Stearate

| Solvent/Co-solvents | Solubility | Solubility limit g/100 g |
|---|---|---|
| Ethanol | x | |
| Ethylene glycol | x | |
| Ethylene glycol/Butanol (1:1) | ✓ | 4.66 |
| Ethylene glycol/Isopropanol (1.4:1) | ✓ | 0.35 |
| Isopropanol | x | |
| Methanol | x | |
| Octanol | x | |

TABLE 2C

Salt: Sodium Palmitate

| Solvent/Co-solvents | Solubility | Solubility limit g/100 g |
|---|---|---|
| Acetone | x | |
| Butanol | x | |
| Ethanol | x | |
| Ethanol/Hexane (1:1) | x | |
| Ethylene glycol | x | |
| Ethylene glycol/Butanol/Isopropanol (1:1:1) | x | |
| Ethylene glycol/Butanol/Methanol (1:1:1) | x | |
| Ethylene glycol/Butanol (1:1) | ✓ | 18.00 |
| Ethylene glycol/Butanol/Methanol/Isopropanol (1:1:1:1) | x | |
| Ethylene glycol/Ethanol (1:1) | ✓ | 4.66 |
| Ethylene glycol/Ethanol/Methanol/Isopropanol (1:1:1:1) | ✓ | 2.11 |
| Ethylene glycol/Isopropanol (1.4:1) | x | |
| Ethylene glycol/Methanol (1:1) | ✓ | 5.26 |
| Ethylene glycol/Methanol/EMIBF4 (2:2:1) | x | |
| Ethylene glycol/Methanol/EMIBF4/BMIBF4 (2:2:1:1) | x | |
| Ethylene glycol/Methanol/Isopropanol (1:1:1) | ✓ | 5.10 |
| Hexane | x | |
| Hexane/Ethylene glycol (2:1) | x | |
| Isopropanol | x | |
| Methanol | ✓ | 0.80 |
| Octanol | x | |

The anolyte solution may optionally contain a supporting electrolyte which is soluble in the solvent and which provides high electrolyte conductivity in the anolyte solution. One non-limiting example of a supporting electrolyte includes an alkali metal tetrafluoroborate. Another example may include tetramethylammonium hexafluorophosphate. Other ionic solids may also be used.

Certain alkali ion conductive membranes, such as ceramic NaSICON and NaSICON-type membranes, have a high temperature tolerance and thus the anolyte solution may be heated to a higher temperature without substantially affecting the temperature of the catholyte solution (or vice versa). NaSICON and NaSICON-type ceramic membranes can be heated and still function effectively at higher temperatures.

This means that polar solvents (or non-polar solvents) that dissolve fatty acids and sodium salts at high temperatures may be used in the anolyte solution. For example, palmitic acid may be heated to form a liquid and this liquid is an excellent solvent for sodium palmitate. At the same time, the catholyte solution is unaffected by temperature. In fact, a different solvent system could simultaneously be used in the catholyte compartment. Alternatively, other molten salts or acids may be used to dissolve ionic sodium carboxylic acids and salts in the anolyte. Long chain hydrocarbons, ethers, triglycerides, esters, alcohols, or other solvents may dissolve carboxylic acids and sodium salts. Such compounds could be used as the anolyte solvent without affecting the catholyte. Ionic liquids could also be used as the anolyte solvent. These materials not only would dissolve large quantities of fatty acid sodium salts, but also, may operate to facilitate the decarboxylation reaction at higher temperatures. Ionic liquids are a class of chemicals with very low vapor pressure and excellent dissolving abilities/dissolving properties. A variety of different ionic liquids may be used.

Under the influence of electric potential 122, electrochemical (anodic) decarboxylation reactions take place at the anode 116 resulting in the formation of carbon dioxide 132 and alkyl radicals ($R^{\bullet}$). The alkyl radicals react with the aryl compound under conditions that permit aryl-alkyl carbon-carbon coupling, thereby forming the aryl-alkyl surfactant precursor, and optionally other reaction products which may be removed from the anolyte compartment 112 in product stream 134.

In some disclosed embodiments, a catholyte solution feed stream 136 is fed into the catholyte compartment 114. The catholyte solution may comprise a solvent that is the same or different than the anolyte solvent. The anolyte and catholyte solvents may be different because the alkali conductive membrane isolates the compartments 112 and 114 from each other. Thus, the anolyte and catholyte solvents may be each separately selected for the reactions in each particular compartment (and/or to adjust the solubility of the chemicals in each particular compartment). Thus, the designer of the cell 100 may tailor the anolyte and catholyte solvents for the reaction occurring in the specific compartment, without having to worry about the solvents mixing and/or the reactions occurring in the other compartment. The catholyte solvent may comprise a mixture of solvents.

In one disclosed embodiment, the catholyte solution comprises water. At least initially, the catholyte solution feed stream 136 preferably includes alkali ions, which may be in the form of an unsaturated alkali hydroxide solution. The concentration of alkali hydroxide is between about 0.1% by weight and about 50% by weight of the solution. In one embodiment, the catholyte solution feed stream 136 includes a dilute solution of alkali hydroxide. During operation, the source of alkali ions may be provided by alkali ions 120 transporting across the alkali ion conductive membrane 110 from the anolyte compartment 112 to the catholyte compartment 114. While alkali hydroxide is used in the following discussion, persons skilled in the art will appreciate that methanol may substitute alkali hydroxide in the apparatus for preparing alkali methylate instead. Thus, feed stream 136 may comprise methanol.

At the cathode 118, reduction of water to form hydrogen gas 138 and hydroxide ions takes place (Reaction 1). The hydroxide ions react with available alkali ions ($M^+$) 120 (transported from anode compartment 112 via the alkali conductive membrane 110) to form alkali hydroxide as shown in Reaction (2). The alkali hydroxide may be recovered in catholyte product stream 140.

$$2H_2O+2e^- \rightarrow H_2+2OH^- \quad (1)$$

$$M^++2H_2O+2e^- \rightarrow 2MOH+H_2 \quad (2)$$

In the case of catholyte solution feed stream 136 comprising methanol, methoxide ions will react with available alkali ions to form alkali methoxide as shown in Reaction (3).

$$2M^++2CH_3OH+2e^- \rightarrow 2MOCH_3+H_2 \quad (3)$$

The alkali methoxide may be recovered in catholyte product stream 140.

It will be appreciated that the catholyte product stream 140 comprises a base which may be used to neutralize the alkyl carboxylic acid to produce the alkali metal salt of an alkyl carboxylic acid 128. Thus, the base consumed in the acid neutralization step may be produced in the catholyte compartment, recovered, and re-used in future acid neutralization reactions or other chemical processes.

In one embodiment of the processes and apparatus of the present invention, the electrolytic cell 100 may be operated in a continuous mode. In a continuous mode, the cell is initially filled with anolyte solution and catholyte solution and then, during operation, additional solutions are fed into the cell and products, by-products, and/or diluted solutions are removed from the cell without ceasing operation of the cell. The feeding of the anolyte solution and catholyte solution may be done continuously or it may be done intermittently, meaning that the flow of a given solution is initiated or stopped according to the need for the solution and/or to maintain desired concentrations of solutions in the cell compartments, without emptying any one individual compartment or any combination of the two compartments. Similarly, the removal of solutions from the anolyte compartment and the catholyte compartment may also be continuous or intermittent. Control of the addition and/or removal of solutions from the cell may be done by any suitable means. Such means include manual operation, such as by one or more human operators, and automated operation, such as by using sensors, electronic valves, laboratory robots, etc. operating under computer or analog control. In automated operation, a valve or stopcock may be opened or closed according to a signal received from a computer or electronic controller on the basis of a timer, the output of a sensor, or other means. Examples of automated systems are well known in the art. Some combination of manual and automated operation may also be used. Alternatively, the amount of each solution that is to be added or removed per unit time to maintain a steady state may be experimentally determined for a given cell, and the flow of solutions into and out of the system set accordingly to achieve the steady state flow conditions.

In another embodiment, the electrolytic cell 100 is operated in batch mode. In batch mode, the anolyte solution and catholyte solution are fed initially into the cell and then the cell is operated until the desired concentration of product is produced in the anolyte and catholyte. The cell is then emptied, the products collected, and the cell refilled to start the process again. Alternatively, combinations of continuous mode and batch mode production may be used. Also, in either mode, the feeding of solutions may be done using a pre-prepared solution or using components that form the solution in situ.

It should be noted that both continuous and batch mode have dynamic flow of solutions. In one embodiment of continuous mode operation, the anolyte solution is added to the anolyte compartment so that the sodium concentration is maintained at a certain concentration or concentration range during operation of the electrolytic cell 100. In one embodiment of batch mode operation, a certain quantity of alkali ions are transferred through the alkali ion conductive membrane to the catholyte compartment and are not replenished, with the cell operation is stopped when the alkali ion concentration in the anolyte compartment reduces to a certain amount or when the appropriate product concentration is reached in the catholyte compartment.

As disclosed above, the anolyte solution 124 comprises a solvent 126, an alkali metal salt of an alkyl carboxylic acid 128, and an aryl compound 130. The aryl compound may take different forms, and the choice of aryl compound will determine the method for preparing the desired aryl-alkyl surfactant precursor. Method 1 applies where the aryl compound comprises an alkali metal salt of an aryl carboxylic acid. Method 2 applies where the aryl compound comprises an arene hydrocarbon. Method 3 applies where the aryl compound comprises an alkali metal-arene adduct ($Ar^-M^+$).

Method 1: The first step is conversion of the aryl carboxylic acid (ArCOOH) and the alkyl carboxylic acid (RCOOH) to alkali metal salts via an acid neutralization process using a base such as alkali methoxide (Reactions 4A and 4C) or alkali hydroxide (Reactions 4B and 4D).

$$RCOOH+CH_3OM \rightarrow RCOOM+CH_3OH \quad (4A)$$

$$RCOOH+MOH \rightarrow RCOOM+H_2O \quad (4B)$$

$$ArCOOH+CH_3OM \rightarrow ArCOOM+CH_3OH \quad (4C)$$

$$ArCOOH+MOH \rightarrow ArCOOM+H_2O \quad (4D)$$

Wherein M is an alkali metal such as lithium, sodium or potassium; RCOOH is a carboxylic acid and R is an alkyl hydrocarbon having a $C_8$ to $C_{24}$ hydrocarbon chain, Ar is an arene (also known as an aromatic or aryl)hydrocarbon. In some embodiments R is derived from a fatty acid. It is within the scope of the invention to obtain the alkyl carboxylate salts by saponification (alkaline hydrolysis) of certain fats and oils (triglycerides).

The RCOOM and ArCOOM are combined with a suitable solvent to prepare an anolyte solution. The anolyte solution may optionally include a supporting electrolyte which is soluble in the solvent and provides high electrolyte conductivity in the anolyte solution. The anolyte solution is fed into an electrochemical cell, such as cell 100 shown in FIG. 1.

In this disclosed method, under the influence of electric potential, electrochemical (anodic) decarboxylation reactions take place at the anode resulting in the formation of carbon dioxide, alkyl radicals ($R^\bullet$), and aryl radicals ($Ar^\bullet$) according to Reactions 5 and 6, below.

$$R—COOM \rightarrow R^\bullet+CO_2+e^-+M^+ \quad (5)$$

$$Ar—COOM \rightarrow Ar^\bullet+CO_2+e^-+M^+ \quad (6)$$

The alkyl radicals react with the aryl radicals under conditions that permit aryl-alkyl carbon-carbon coupling, thereby forming the aryl-alkyl surfactant precursor, and optionally other reaction products. Non-limiting examples of the free radical reaction steps are shown below.

$$R^\bullet+Ar^\bullet \rightarrow R—Ar \text{ (cross dimerization)} \quad (7)$$

$$R^\bullet+R^\bullet \rightarrow R—R \text{ (alkyl hydrocarbon dimerization)} \quad (8)$$

$$Ar^\bullet+Ar^\bullet \rightarrow Ar—Ar \text{ (arene dimerization)} \quad (9)$$

Note that the radical in the case of $Ar^\bullet$ is a radical present on the aromatic carbon (i.e. associated with the aromatic ring). Alternatively radicals can also be formed on alkyl groups attached to the aromatic ring in which case different products than from above can be formed. For example, if the alkali salt of the alkyl caroxylic acid is $Ar—CH_2—COOM$, non-limiting examples of possible free radical reactions are shown below:

$$Ar—CH_2—COOM \rightarrow Ar—CH_2^\bullet+CO_2+e^-+M^+ \quad (10)$$

$$Ar—CH_3+R^\bullet \rightarrow Ar—CH_2^\bullet+R—H \text{ (hydrogen abstraction)} \quad (11)$$

$$R^\bullet+Ar—CH_2 \rightarrow R—Ar \text{ (cross dimerization)} \quad (12)$$

$$R^\bullet+R^\bullet \rightarrow R—R \text{ (alkyl hydrocarbon dimerization)} \quad (8)$$

$$Ar—CH_2^\bullet+Ar \rightarrow Ar—CH_2—Ar \text{ (arene dimerization)} \quad (13)$$

$$Ar^\bullet+Ar^\bullet \rightarrow Ar—Ar \text{ (arene dimerization)} \quad (9)$$

The above decarboxylation and radical formation reactions are typically conducted in aqueous or non-aqueous solutions at high current densities. Once the R—Ar surfactant precursor is formed, the product may be recovered for further processing. For instance, the aromatic ring may be sulfonated, preferably at the para site, to form the surfactant product ($R—Ar—HSO_4$).

Some advantages of this embodiment, using alkali metal salt of the alkyl carboxylic acid instead of carboxylic acid itself in the above mentioned two compartment electrolytic cell are:

1. R—COOM is more polar than R—COOH and so more probable to decarboxylate at lower voltages.
2. The electrolyte conductivity may be higher for alkali metal salts of fatty acids than fatty acids themselves.
3. The anolyte and catholyte solutions can be completely different allowing favorable reactions to take place at either electrode.

The alkali ion conductive solid electrolyte membrane selectively transfers alkali ions ($M^+$) from the anolyte compartment to the catholyte compartment under the influence of an electrical potential while preventing anolyte solution and catholyte solution mixing.

Non-limiting examples of suitable the catholyte solutions include aqueous alkali hydroxide and non aqueous methanol/alkali methoxide solution. An electrochemically active cathode is housed in the catholyte compartment, where reduction reactions take place according to Reactions 1, 2, or 3. The base used in the acid neutralization reaction may be regenerated in the catholyte compartment.

Method 2: The first step is conversion of the alkyl carboxylic acid (RCOOH) to alkali metal salts via an acid neutralization process using a base such as alkali methoxide (Reaction 4A) or alkali hydroxide (Reaction 4B).

$$RCOOH+CH_3OM \rightarrow RCOOM+CH_3OH \quad (4A)$$

$$RCOOH+MOH \rightarrow RCOOM+H_2O \quad (4B)$$

Wherein R and M are as defined above. The next step is to mix RCOOM and an arene hydrocarbon (Ar) with a suitable solvent to prepare an anolyte solution. The anolyte solution may optionally include a supporting electrolyte.

The anolyte solution is fed into an electrolytic cell as described in Method 1, where oxidation (decarboxylation) reaction and subsequent free radical carbon-carbon coupling takes place. The free radical reaction steps are shown below with the arene hydrocarbon being benzene as an example:

$$R—COOM \rightarrow R^\bullet+CO_2+e^-+M^+ \quad (5)$$

The alkali ion ($M^+$) transfers through the alkali ion conductive membrane from the anolyte compartment to the catholyte compartment. The alkyl radical ($R^\bullet$) reacts with the benzene (Ar) to form an intermediate according to Reaction (14). The alkyl radical can react with itself according to Reaction (8):

$$R^{\bullet}+C_6H_6 \rightarrow [R—C_6H_6^{\bullet}] \text{ intermediate} \quad (14)$$

$$R^{\bullet}+R^{\bullet} \rightarrow R—R \text{ (alkyl hydrocarbon dimerization)} \quad (8)$$

The intermediate may undergo any of the following non-limiting reactions:

$$[R—C_6H_6^{\bullet}]+R^{\bullet} \rightarrow R—C_6H_5+RH \text{ (hydrogen abstraction by the second } R^{\bullet}) \quad (15)$$

$$[R—C_6H_6^{\bullet}]+[R—C_6H_6^{\bullet}] \rightarrow R—C_6H_5+R—C_6H_7 \text{ (disproportionation)} \quad (16)$$

$$[R—C_6H_6^{\bullet}]+[R—C_6H_6^{\bullet}] \rightarrow 2R—C_6H_6 \text{ (arene dimerization)} \quad (17)$$

In the case of $C_6H_6^{\bullet}$ the radical is present on the aromatic carbon (i.e. associated with the aromatic ring). Alternatively radicals can also be formed on alkyl groups attached to the aromatic ring in which case different products can be formed, non-limiting examples of which are shown below:

$$C_6H_6—CH_3+R^{\bullet} \rightarrow C_6H_6—CH_2^{\bullet}R—H \text{ (hydrogen abstraction by the second } R^{\bullet}) \quad (18)$$

$$R^{\bullet}+C_6H_6—CH_2^{\bullet} \rightarrow R—CH_2—C_6H_6 \text{ (cross dimerization)} \quad (19)$$

$$R^{\bullet}+R^{\bullet} \rightarrow R—R \text{ (alkyl hydrocarbon dimerization)} \quad (8)$$

$$C_6H_6—CH_2^{\bullet}+C_6H_6^{\bullet} \rightarrow C_6H_6—CH_2—C_6H_6 \text{ (arene dimerization)} \quad (20)$$

$$C_6H_6—CH_2^{\bullet}+C_6H_6—CH_2^{\bullet} \rightarrow C_6H_6—CH_2—CH_2—C_6H_6 \text{ (arene dimerization)} \quad (21)$$

Once the desired R—Ar surfactant precursor is formed, the product may be recovered for further processing. For instance, the aromatic ring may be sulfonated, preferably at the para site, to form the surfactant product ($R—Ar—HSO_4$).

Method 3: The first step is conversion of the alkyl carboxylic acid (RCOOH) to alkali metal salts via an acid neutralization process using a base such as alkali methoxide (Reaction 4A) or alkali hydroxide (Reaction 4B).

$$RCOOH+CH_3OM \rightarrow RCOOM+CH_3OH \quad (4A)$$

$$RCOOH+MOH \rightarrow RCOOM+H_2O \quad (4B)$$

Wherein R and M are as defined above. The next step is to mix an arene hydrocarbon with an equimolar amount of alkali metal to form an $Ar^-M^+$ adduct as described in the following reference: Donald E. Paul, David Lipkin, S. I. Weissman "Reaction of Sodium Metal with Aromatic Hydrocarbons" J. Am. Chem. Soc., 1956, 78 (1), pp 116-120.

The next step is to mix RCOOM and the $Ar^-M^+$ adduct to prepare an anolyte solution. The anolyte solution may optionally include a supporting electrolyte.

The anolyte solution is fed into an electrolytic cell as described in Method 1, where oxidation (decarboxylation) reaction and subsequent free radical carbon-carbon coupling takes place. The free radical reaction steps are shown below with the arene hydrocarbon being benzene as an example:

$$R—COOM \rightarrow R^{\bullet}+CO_2+e^-+M^+ \quad (5)$$

The alkyl radical will lose an electron to form a carbocation ($R^+$) as follows:

$$R^{\bullet} \rightarrow R^+ + e^- \quad (21)$$

Reaction (21) may occur at a high current density. In one embodiment reaction (21) occurs at a current density greater than about 100 $mA/cm^2$ of anode area.

The carbocation ($R^+$) then reacts with the alkali metal aryl $Ar^-M^+$ adduct to form the aryl-alkyl product as follows:

$$R^+ + Ar^-M^+ \rightarrow R—Ar+M^+ \quad (22)$$

The alkali ion ($M^+$) transfers through the alkali ion conductive membrane from the anolyte compartment to the catholyte compartment. Once the R—Ar surfactant precursor is formed, the product may be recovered for further processing. For instance, the aromatic ring may be sulfonated, preferably at the para site, to form the surfactant product ($R—Ar—HSO_4$).

The decarboxylation and radical formation reactions as depicted above in relation to all three methods are believed to be stoichiometric. However, by changing the stoichiometric ratio of the reactants, it is possible to change the product compositions. For example, if excess of Ar—COOM is used in the above reaction, it is probable to increase the formation of Ar—Ar and R—Ar compared to R—R. Thus it is possible to tailor the process to maximize the desirable products and reduce the formation of undesirable products.

The product ratio may also be varied by changing the current density at which the decarboxylation takes place. As an example, it may be possible to vary the formation of one type of radicals predominantly compared to a different type (radicals of the type $Ar—CH_2^{\bullet}$ where the radical is associated with alkyl group associated with aromatic carbon compared to $^{\bullet}Ar—CH_2$ where the radical is associated with the aromatic ring carbon) changing the product selection and composition.

Figure 2:
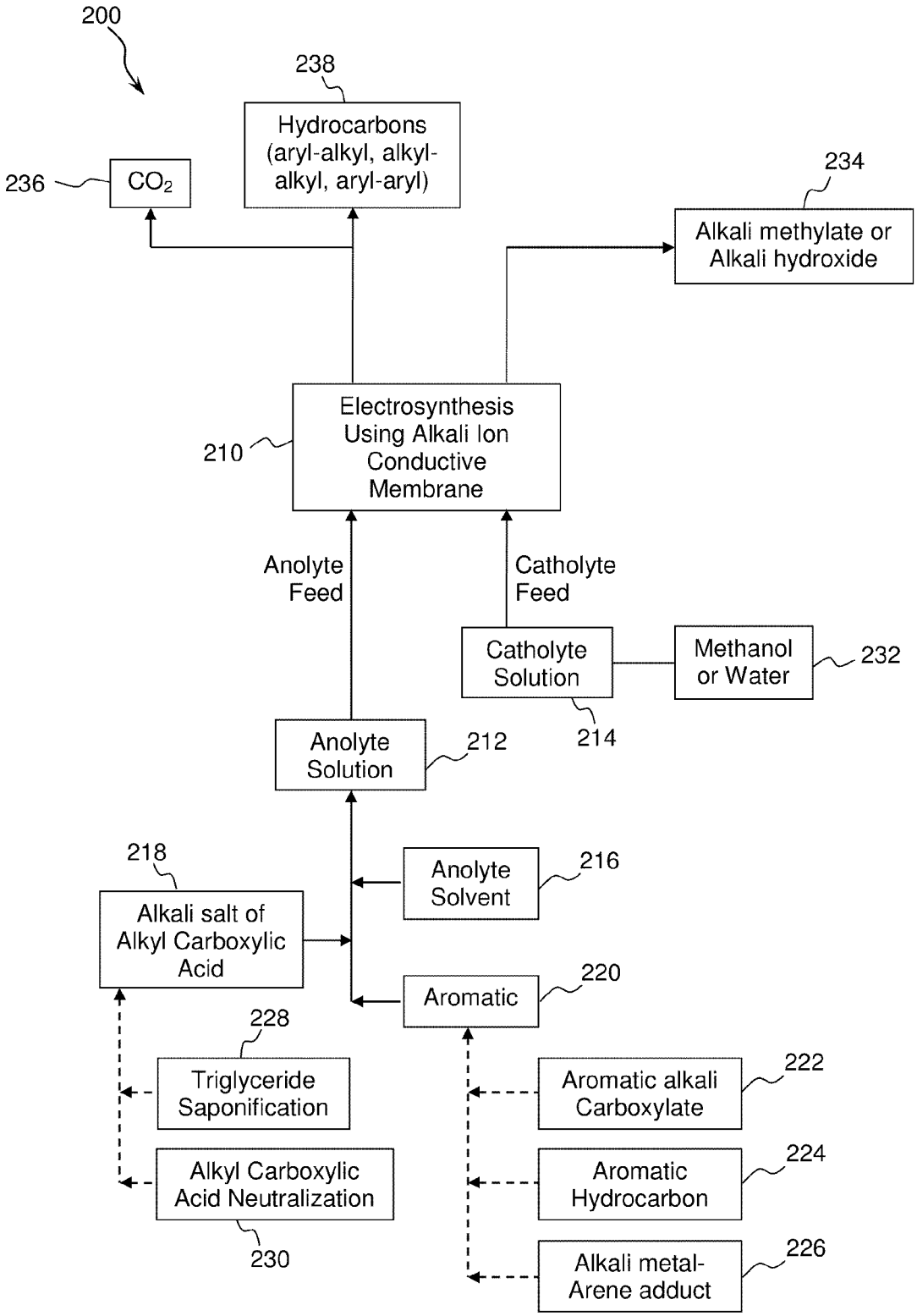
FIG. 2 shows a schematic diagram of one disclosed process for the manufacture of aryl-alkyl hydrocarbons from inexpensive starting materials.

FIG. 2 illustrates a schematic diagram of one disclosed process 200 for the manufacture of aryl-alkyl hydrocarbons from inexpensive starting materials. The process utilizes an electrolytic cell which can perform electrosynthesis 210 using an alkali ion conductive membrane that divides the cell into an anolyte compartment and a catholyte compartment. The electrolytic cell is operated by feeding an anolyte solution 212 into the anolyte compartment and a catholyte solution 214 into the catholyte compartment.

The anolyte solution 212 comprises an anolyte solvent 216, an alkali metal salt of an alkyl carboxylic acid 218, and an aromatic or aryl compound 220. In some embodiments, the aromatic compound 220 may comprise an alkali metal salt of an aromatic carboxylic acid 222. In some embodiments, the aromatic compound may comprise an aromatic (arene) hydrocarbon 224. In some embodiments, the aromatic compound 220 may comprise an alkali metal-arene adduct ($Ar^-M^+$) 226. In some embodiments, the alkali metal salt of an alkyl carboxylic acid 218 may be obtained by saponification of an oil or fat triglyceride 228. In some embodiments the alkali metal salt of an alkyl carboxylic acid 218 may be obtained by acid neutralization 230 of an alkyl carboxylic acid, such as a fatty acid. In such cases, the alkyl carboxylic acid may comprise an alkyl hydrocarbon having a $C_8$ to $C_{24}$ hydrocarbon chain.

The catholyte solution 214 may comprise a solvent that is the same or different than the anolyte solvent. In one disclosed embodiment, the catholyte solution comprises methanol or water 232. Under the influence of an electric potential, the catholyte solution reacts to form a base 234 comprising an alkali methylate (methoxide) or an alkali hydroxide, depending upon the composition of the catholyte solution. The base 234 may be recovered and used to prepare the alkali salt of the alkyl carboxylic acid 218.

Under the influence of an electric potential, the anolyte solution undergoes electrochemical (anodic) decarboxylation reactions resulting in the formation of carbon dioxide 236 and alkyl radicals ($R^{\bullet}$). The alkyl radicals react with the aromatic compound 220 under conditions that permit aryl-alkyl carbon-carbon coupling, thereby forming aryl-alkyl hydrocarbons 238. Other hydrocarbon products may also be produced, including but not limited to, alkyl-alkyl and aryl-aryl hydrocarbons.

The following examples are given to illustrate various embodiments within the scope of the present invention. These are given by way of example only, and it is understood that the following examples are not comprehensive or exhaustive of the many types of embodiments of the present invention that can be prepared in accordance with the present invention.

EXAMPLES

Several experiments were performed to demonstrate technical feasibility of the electrolytic decarboxylation process (EDP) described herein for manufacturing aryl-alkyl precursors from inexpensive starting materials and to perform the synthesis reaction at low temperature and low pressure without the use of catalysts. The experiments demonstrated the decarboxylation of sodium salts of aromatic and aliphatic carboxylic acids in electrolytic cells utilizing a NaSelect® NaSICON membrane manufactured by Ceramatec, Inc., Salt Lake City, Utah, to make mixed aromatic-aliphatic hydrocarbon products.

Example 1

A mixture comprising an aryl carboxylic acid salt and an alkyl carboxylic acid salt was converted to an aryl-alkyl hydrocarbon by electrolytic (anodic) decarboxylation of both the aryl carboxylate and the alkyl carboxylate and subsequent aryl-alkyl carbon-carbon coupling. An equimolar mixture of sodium benzoate and sodium acetate was dissolved in a solvent comprising 20% water and 80% methanol to form an anolyte solution.

Approximately 300 mL of the anolyte solution was introduced into a two-compartment micro electrolysis reactor with minimal membrane-anode gap. The anolyte solution flow rate ranged from 60-100 ml/min. The electrolysis reactor contained a 1 mm thick NaSelect® NaSICON membrane having a 1 inch diameter. A smooth platinum anode and a nickel cathode were used in the electrolysis reactor. A 15 wt. % NaOH catholyte solution was used in the catholyte compartment. The electrolysis reactor was operated at a current density of 200-300 mA per $cm^2$ of membrane area. The operating temperature was approximately 40° C.

The electrolysis reactor was operated in batch mode, i.e. the anolyte and catholyte solutions are re-circulated until ~40-50% of the sodium salts are converted to hydrocarbons in the anolyte compartment and form sodium hydroxide in the catholyte compartment.

It is within the scope of the invention to operate the electrolysis reactor in a semi-continuous mode, i.e. the anolyte and catholyte solutions are re-circulated until a pre-determined amount of sodium salt starting material (e.g. 10%) is converted to hydrocarbons in the anolyte compartment. A continuous process is preferred for processing hydrocarbons at large scale in which the starting salt concentration is always maintained and the hydrocarbon product is continuously removed.

The electrolytic decarboxylation reactions are shown below:

$$CH_3COONa \rightarrow CH_3^{\bullet} + CO_2 + e^- + Na^+$$

$$C_6H_5COONa \rightarrow C_6H_5^{\bullet} + CO_2 + e^- + Na^+$$

Figure 3:
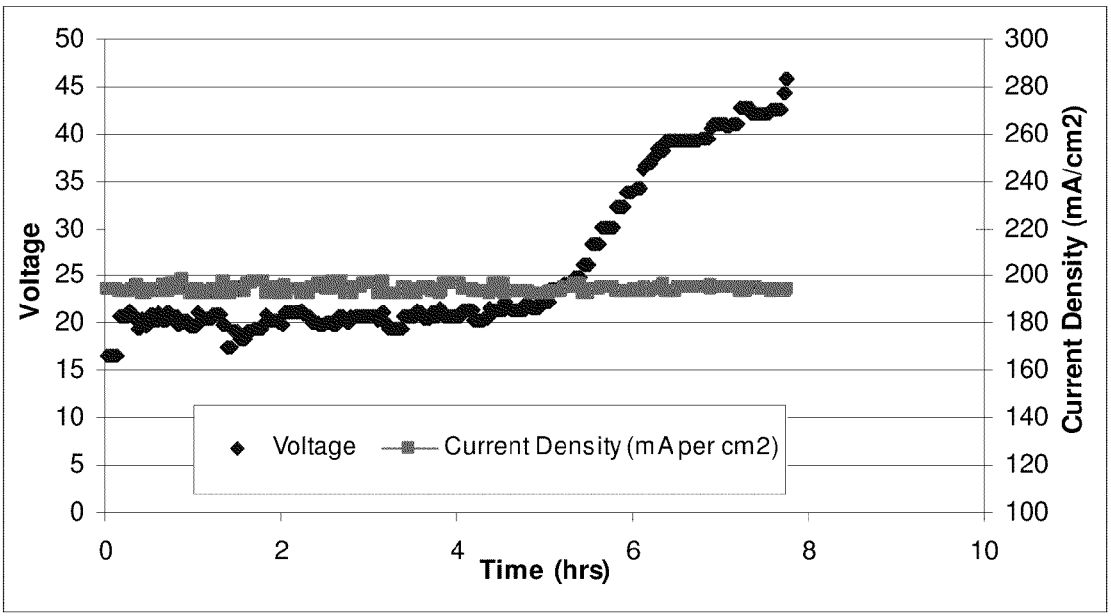
FIG. 3 is a graph showing voltage and current density verses time for Example 1.

The evolved carbon dioxide was detected using an IR sensor and by lime-water analysis. FIG. 3 contains a graph showing voltage and current density verses time for this example. The alkyl radicals reacted with the aryl radicals under conditions that permit aryl-alkyl carbon-carbon coupling, thereby forming the aryl-alkyl product and other reaction products based upon the following non-limiting reactions.

$$CH_3^{\bullet} + C_6H_5^{\bullet} \rightarrow C_6H_5{-}CH_3 \text{ (cross dimerization)}$$

$$CH_3^{\bullet} + CH_3^{\bullet} \rightarrow CH_3{-}CH_3 \text{ (alkyl hydrocarbon dimerization)}$$

$$C_6H_5^{\bullet} + C_6H_5^{\bullet} \rightarrow C_6H_5{-}C_6H_5 \text{ (arene dimerization)}$$

The reaction products were extracted with dodecane. The reaction products were analyzed by gas chromatography (GC). The following products were observed:

Benzene: 70 mg/kg

Ethyl benzene: 270 mg/kg

Toluene: <50 mg/kg

Other peaks in the GC pattern were left unidentified. The formation of ethyl benzene was not expected. Without being bound by theory, the ethyl benzene may have formed from toluene by the following mechanism:

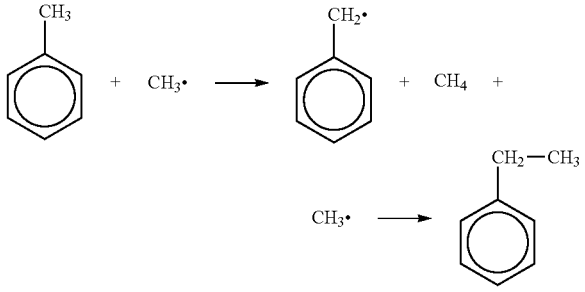

Example 2

A mixture comprising an alkyl carboxylic acid salt and an arene hydrocarbon (benzene in this example) was converted to an aryl-alkyl hydrocarbon by electrolytic (anodic) decarboxylation of the alkyl carboxylate and subsequent aryl-alkyl carbon-carbon coupling. An equimolar mixture of benzene and sodium acetate was dissolved in methanol to form an anolyte solution.

The anolyte solution was introduced into a two-compartment micro electrolysis reactor and operated as described in Example 1. The electrolytic decarboxylation reaction is shown below:

$$CH_3COONa \rightarrow CH_3^{\bullet} + CO_2 + e^- + Na^+$$

Figure 4:
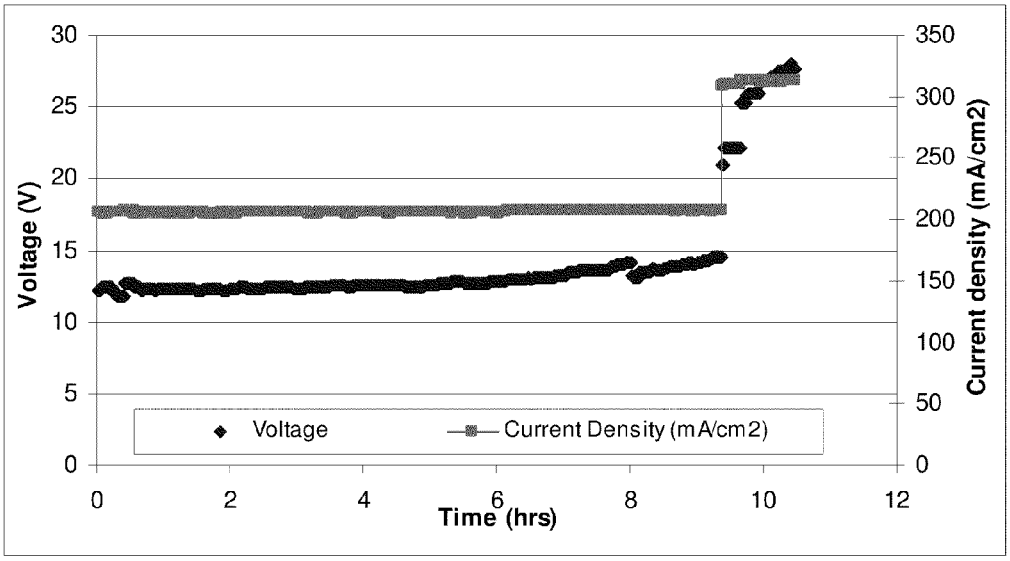
FIG. 4 is a graph showing voltage and current density verses time for Example 2.

The evolved carbon dioxide was detected using an IR sensor and by lime-water analysis. FIG. 4 contains a graph showing voltage and current density verses time for this example. The alkyl radicals reacted with the aryl radicals under conditions that permit aryl-alkyl carbon-carbon coupling, thereby forming the aryl-alkyl product and other reaction products based upon the following non-limiting reactions.

$$[CH_3{-}C_6H_6^{\bullet}] + CH_3^{\bullet} \rightarrow CH_3{-}C_6H_5 + CH_4 \text{ (hydrogen abstraction by } CH_3^{\bullet})$$

$$[CH_3{-}C_6H_6^{\bullet}] + [CH_3{-}C_6H_6^{\bullet}] \rightarrow CH_3{-}C_6H_5 + CH_3{-}C_6H_7 \text{ (disproportionation)}$$

$$[CH_3{-}C_6H_6^{\bullet}] + [CH_3{-}C_6H_6^{\bullet}] \rightarrow 2CH_3{-}C_6H_6 \text{ (arene dimerization)}$$

The reaction products were extracted with non polar extractants such as dodecane. The reaction products were analyzed by gas chromatography (GC). The following products were observed:

Ethyl benzene: 250 mg/kg

Methyl acetate: 220 mg/kg

Toluene: 150 mg/kg

Toluene was produced, proving aryl-alkyl coupling. Without being bound by theory, it is believe the ethyl benzene was formed from toluene as described in Example 1. The methyl acetate was formed by reaction of methanol and sodium acetate. Other peaks in the GC pattern were left unidentified.

Example 3

A mixture comprising an alkyl carboxylic acid salt and an arene hydrocarbon (ethyl benzene in this example) was converted to an aryl-alkyl hydrocarbon by electrolytic (anodic) decarboxylation of the alkyl carboxylate and subsequent aryl-alkyl carbon-carbon coupling. An equimolar mixture of ethyl benzene and sodium propionate was dissolved in methanol to form an anolyte solution.

The anolyte solution was introduced into a two-compartment micro electrolysis reactor and operated as described in Example 1. The electrolytic decarboxylation reaction is shown below:

$$CH_3CH_2COONa \rightarrow C_2H_5^{\bullet} + CO_2 + e^- + Na^+$$

Figure 5:
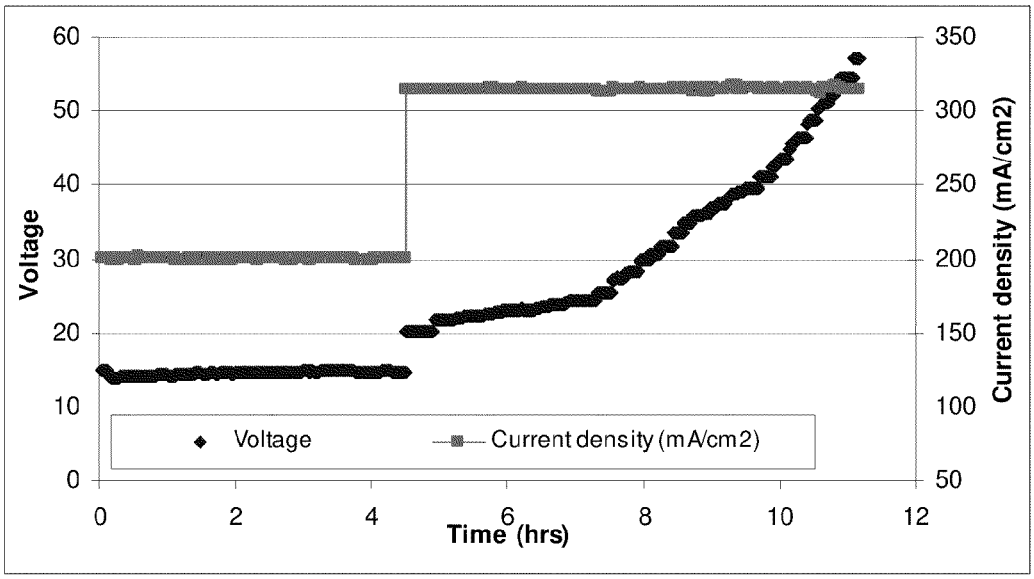
FIG. 5 is a graph showing voltage and current density verses time for Example 3.

The evolved carbon dioxide was detected using an IR sensor and by lime-water analysis. FIG. 5 contains a graph showing voltage and current density verses time for this example. The alkyl radicals reacted with the aryl radicals under conditions that permit aryl-alkyl carbon-carbon coupling, thereby forming the aryl-alkyl product and other reaction products based upon the following non-limiting reactions.

$$[(C_2H_5)_2—C_6H_6^{\bullet}] + C_2H_5^{\bullet} \rightarrow (C_2H_5)_2—C_6H_5 + C_2H_6$$
(hydrogen abstraction by $C_2H_5^{\bullet}$)

$$[(C_2H_5)_2—C_6H_6^{\bullet}] + [(C_2H_5)_2—C_6H_6^{\bullet}] \rightarrow (C_2H_5)_2—C_6H_5 + (C_2H_5)_2—C_6H_7$$
(disproportionation)

$$[(C_2H_5)_2—C_6H_6^{\bullet}] + [(C_2H_5)_2—C_6H_6^{\bullet}] \rightarrow 2C_2H_5—C_6H_5 + H_2$$
(arene dimerization)

The reaction products were extracted with non polar extractants such as dodecane. The reaction products were analyzed by gas chromatography (GC). The following products were observed:

Butane: 120 mg/kg 1,2-diethylbenzene: 438 mg/kg 1,2,3-Trimethylbenzene: 120 mg/kg Benzene: 360 mg/kg Sec-butylbenzene: 57 mg/kg Toluene: 190 mg/kg Diethyl benzene was produced, proving aryl-alkyl coupling. 1,2,3-trimethyl benzene, benzene, sec-butylbenzene, toluene were also formed. Without being bound by theory, it is believed these products were formed due to complex rearrangements and bond cleavages. Other peaks in the GC pattern were left unidentified.

Example 4

A mixture comprising an alkyl carboxylic acid salt and an arene hydrocarbon (methyl naphthalene in this example) was converted to an aryl-alkyl hydrocarbon by electrolytic (anodic) decarboxylation of the alkyl carboxylate and subsequent aryl-alkyl carbon-carbon coupling. An equimolar mixture of methyl naphthalene and sodium acetate was dissolved in methanol to form an anolyte solution.

The anolyte solution was introduced into a two-compartment micro electrolysis reactor and operated as described in Example 1. The electrolytic decarboxylation reaction is shown below:

$$CH_3COONa \rightarrow CH_3^{\bullet} + CO_2 + e^- + Na^+$$

Figure 6:
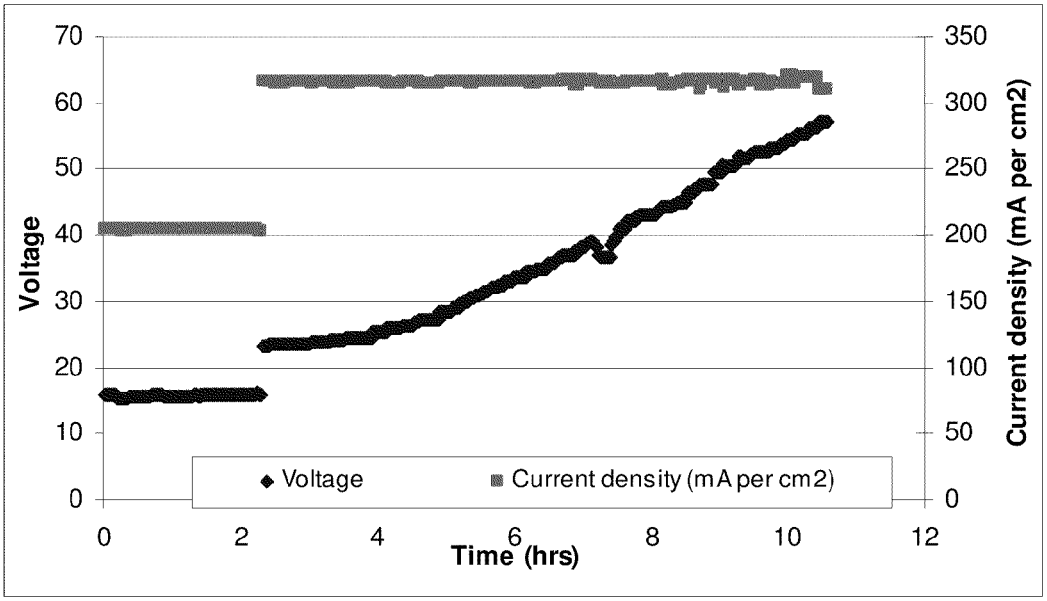
FIG. 6 is a graph showing voltage and current density verses time for Example 4.

The evolved carbon dioxide was detected using an IR sensor and by lime-water analysis. FIG. 6 contains a graph showing voltage and current density verses time for this example. The alkyl radicals reacted with the aryl radicals under conditions that permit aryl-alkyl carbon-carbon coupling, thereby forming the aryl-alkyl product and other reaction products based upon the following non-limiting reactions.

$$[(CH_3)_2—C_{10}H_7^{\bullet}] + CH_3^{\bullet} \rightarrow (CH_3)_2—C_{10}H_6 + CH_4$$
(hydrogen abstraction by $CH_3^{\bullet}$)

$$[(CH_3)_2—C_{10}H_7^{\bullet}] + [(CH_3)_2—C_{10}H_7^{\bullet}] \rightarrow (CH_3)_2—C_{10}H_6 + (CH_3)_2—C_{10}H_8$$
(disproportionation)

$$[(CH_3)_2—C_{10}H_7^{\bullet}] + [(CH_3)_2—C_{10}H_7^{\bullet}] \rightarrow 2(CH_3)_2—C_{10}H_6 + H_2$$
(arene dimerization)

The reaction products were extracted with non polar extractants such as dodecane. The reaction products were analyzed by gas chromatography (GC). The following products were observed:

$C_{11}$-$C_{13}$ alkyl naphthalenes: 170 g/kg 2-benzylidenecyclopentanone: 261 mg/kg

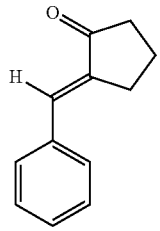

2-methyl-1-naphthalenol: 5.4 g/kg

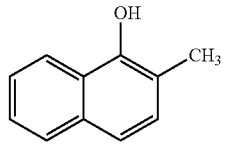

Many other peaks in the GC pattern were left unidentified.

While specific embodiments and examples of the present invention have been illustrated and described, numerous modifications come to mind without significantly departing from the spirit of the invention, and the scope of protection is only limited by the scope of the accompanying claims.

The invention claimed is:

1. A process for producing an aryl-alkyl (R—Ar) compound comprising:

providing an electrolytic cell comprising an alkali ion conductive membrane positioned between an anolyte compartment configured with an anode and a catholyte compartment configured with a cathode, wherein the alkali ion conductive membrane is an alkali ion super ion conductive membrane selected from NaSICON or NaSICON-type membranes, LiSICON or a LiSICON-type membranes, and KSICON or KSICON-type membranes, and wherein said alkali ion conductive membrane being configured to selectively transport alkali ion;

introducing an anolyte solution into the anolyte compartment, wherein the anolyte solution comprises an alkali metal salt of an alkyl carboxylic acid (R—COOM) and an aryl compound in an anolyte solvent, wherein R is an alkyl hydrocarbon having a $C_8$ to $C_{24}$ hydrocarbon chain and M is an alkali metal selected from Li, Na, and K, and wherein the anolyte solvent comprises methanol;

electrolyzing the anolyte solution at the anode to decarboxylate the alkali metal salt of the alkyl carboxylic acid according to the following reaction:

$$R—COOM \rightarrow R^{\bullet}+CO_2+e^{-}+M^{+}$$

wherein $R^{\bullet}$ is a $C_8$ to $C_{24}$ alkyl radical;

reacting $R^{\bullet}$ produced above with the aryl compound to produce an aryl-alkyl compound (R—Ar); and recovering the aryl-alkyl compound produced.

2. The process for producing an aryl-alkyl (R—Ar) compound according to claim 1, wherein the alkali metal salt of the alkyl carboxylic acid is obtained by acid neutralization of the alkyl carboxylic acid.

3. The process for producing an aryl-alkyl (R—Ar) compound according to claim 1, wherein the alkali metal salt of the alkyl carboxylic acid is neutralized by an alkali methoxide or an alkali hydroxide.

4. The process for producing an aryl-alkyl (R—Ar) compound according to claim 1, wherein the aryl-alkyl compound is a surfactant precursor, and wherein an aryl-alkyl surfactant is obtained by sulfonating the aromatic group to form $R—Ar—HSO_4$.

5. The process for producing an aryl-alkyl (R—Ar) compound according to claim 1, wherein the anolyte solvent comprises a supporting electrolyte.

6. The process for producing an aryl-alkyl (R—Ar) compound according to claim 5, wherein the supporting electrolyte comprises an alkali metal tetrafluoroborate.

7. The process for producing an aryl-alkyl (R—Ar) compound according to claim 1, wherein the aryl compound comprises an alkali metal salt of an aryl carboxylic acid (Ar—COOM) which undergoes the electrolyzing step to decarboxylate the alkali metal salt of the aryl carboxylic acid according to the following reaction:

$$Ar—COOM \rightarrow Ar^{\bullet}+CO_2+e^{-}+M^{+}$$

wherein $Ar^{\bullet}$ is an aryl radical, and wherein $Ar^{\bullet}$ reacts with $R^{\bullet}$ to produce the aryl-alkyl compound (R—Ar).

8. The process for producing an aryl-alkyl (R—Ar) compound according to claim 1, wherein the aryl compound comprises an aryl hydrocarbon, and wherein the aryl hydrocarbon reacts with $R^{\bullet}$ to produce the aryl-alkyl compound (R—Ar).

9. The process for producing an aryl-alkyl (R—Ar) compound according to claim 1, wherein the aryl compound comprises an aryl alkali metal adduct ($Ar^{-}M^{+}$), and wherein the $R^{\bullet}$ loses an electron to form $R^{+}$, and wherein the aryl alkali metal adduct ($Ar^{-}M^{+}$) reacts with $R^{+}$ to produce the aryl-alkyl compound (R—Ar).

10. The process for producing an aryl-alkyl (R—Ar) compound according to claim 9, wherein the aryl alkali metal adduct is formed by reaction of an aryl hydrocarbon and an alkali metal.

11. The process for producing an aryl-alkyl (R—Ar) compound according to claim 1, wherein one or more alkyl-alkyl compounds are formed in addition to the aryl-alkyl compound.

12. The process for producing an aryl-alkyl (R—Ar) compound according to claim 1, wherein one or more aryl-aryl compounds are formed in addition to the aryl-alkyl compound.

13. The process for producing an aryl-alkyl (R—Ar) compound according to claim 1, wherein the alkali metal is sodium.

14. The process for producing an aryl-alkyl (R—Ar) compound according to claim 1, further comprising:

introducing a catholyte solution into the catholyte compartment, wherein the catholyte solution comprises water or methanol; and electrolyzing the catholyte solution at the cathode to reduce the catholyte solution to form alkali hydroxide or alkali methoxide according to one of the following reactions:

$$M^{+}+2H_2O+2e^{-} \rightarrow 2MOH+H_2$$

$$2M^{+}+2CH_3OH+2e^{-} \rightarrow 2MOCH_3+H_2.$$

15. The process for producing an aryl-alkyl (R—Ar) compound according to claim 14, further comprising recovering the alkali hydroxide or alkali methoxide.

16. The process for producing an aryl-alkyl (R—Ar) compound according to claim 15, further comprising using the recovered alkali hydroxide or alkali methoxide to prepare the alkali metal salt of an alkyl carboxylic acid.

17. The process for producing an aryl-alkyl (R—Ar) compound according to claim 1, wherein the alkali metal salt of an alkyl carboxylic acid is obtained by a saponification reaction of a triglyceride.

18. The process for producing an aryl-alkyl (R—Ar) compound according to claim 15, further comprising using the recovered alkali hydroxide or alkali methoxide to react with a triglyceride to obtain the alkali metal salt of an alkyl carboxylic acid.

19. A process for producing an aryl-alkyl (R—Ar) compound comprising:

providing an electrolytic cell comprising an alkali ion conductive membrane positioned between an anolyte compartment configured with an anode and a catholyte compartment configured with a cathode, wherein the alkali ion conductive membrane is an alkali ion super ion conductive membrane selected from NaSICON or NaSICON-type membranes, LiSICON or a LiSICON-type membranes, and KSICON or KSICON-type membranes, and wherein said alkali ion conductive membrane being configured to selectively transport alkali ion;

introducing an anolyte solution into the anolyte compartment, wherein the anolyte solution comprises an alkali metal salt of an alkyl carboxylic acid (R—COOM) and an aryl compound in an anolyte solvent, wherein R is an alkyl hydrocarbon having a $C_8$ to $C_{24}$ hydrocarbon chain and M is an alkali metal selected from Li, Na, and K, and wherein the anolyte solvent comprises methanol;

electrolyzing the anolyte solution at the anode to decarboxylate the alkali metal salt of the alkyl carboxylic acid according to the following reaction:

$$R—COOM \rightarrow R^{\bullet}+CO_2+e^{-}+M^{+}$$

wherein $R^{\bullet}$ is a $C_8$ to $C_{24}$ alkyl radical;

reacting $R^{\bullet}$ produced above with the aryl compound to produce an aryl-alkyl compound (R—Ar);

recovering the aryl-alkyl compound produced;

introducing a catholyte solution into the catholyte compartment, wherein the catholyte solution comprises water or methanol;

electrolyzing the catholyte solution at the cathode to reduce the catholyte solution to form alkali hydroxide or alkali methoxide according to one of the following reactions:

$$M^{+}+2H_2O+2e^{-}\rightarrow 2MOH+H_2$$

$$2M^{+}+2CH_3OH+2e^{-}\rightarrow 2MOCH_3+H_2;$$

recovering the alkali hydroxide or alkali methoxide; and using the recovered alkali hydroxide or alkali methoxide to prepare the alkali metal salt of an alkyl carboxylic acid.

20. A process for producing an aryl-alkyl (R—Ar) compound comprising:

providing an electrolytic cell comprising an alkali ion conductive membrane positioned between an anolyte compartment configured with an anode and a catholyte compartment configured with a cathode, wherein the alkali ion conductive membrane is an alkali ion super ion conductive membrane selected from NaSICON or NaSICON-type membranes, LiSICON or a LiSICON-type membranes, and KSICON or KSICON-type membranes, and wherein said alkali ion conductive membrane being configured to selectively transport alkali ion;

introducing an anolyte solution into the anolyte compartment, wherein the anolyte solution comprises an alkali metal salt of an alkyl carboxylic acid (R—COOM) and an aryl compound in an anolyte solvent, wherein R is an alkyl hydrocarbon having a $C_8$ to $C_{24}$ hydrocarbon chain and M is an alkali metal selected from Li, Na, and K, and wherein the anolyte solvent comprises methanol;

electrolyzing the anolyte solution at the anode to decarboxylate the alkali metal salt of the alkyl carboxylic acid according to the following reaction:

$$R—COOM\rightarrow R^{\bullet}+CO_2+e^{-}+M^{+}$$

wherein $R^{\bullet}$ is a $C_8$ to $C_{24}$ alkyl radical;

reacting $R^{\bullet}$ produced above with the aryl compound to produce an aryl-alkyl compound (R—Ar);

recovering the aryl-alkyl compound produced;

introducing a catholyte solution into the catholyte compartment, wherein the catholyte solution comprises water or methanol;

electrolyzing the catholyte solution at the cathode to reduce the catholyte solution to form alkali hydroxide or alkali methoxide according to one of the following reactions:

$$M^{+}+2H_2O+2e^{-}\rightarrow 2MOH+H_2$$

$$2M^{+}+2CH_3OH+2e^{-}\rightarrow 2MOCH_3+H_2;$$

recovering the alkali hydroxide or alkali methoxide; and using the recovered alkali hydroxide or alkali methoxide to react with a triglyceride to obtain the alkali metal salt of an alkyl carboxylic acid.

21. The process for producing an aryl-alkyl (R—Ar) compound according to claim 20, wherein the alkali metal salt of the alkyl carboxylic acid is neutralized by an alkali methoxide or an alkali hydroxide.

22. The process for producing an aryl-alkyl (R—Ar) compound according to claim 20, wherein the aryl-alkyl compound is a surfactant precursor, and wherein an aryl-alkyl surfactant is obtained by sulfonating the aromatic group to form $R—Ar—HSO_4$.

23. The process for producing an aryl-alkyl (R—Ar) compound according to claim 20, wherein the aryl compound comprises an alkali metal salt of an aryl carboxylic acid (Ar—COOM) which undergoes the electrolyzing step to decarboxylate the alkali metal salt of the aryl carboxylic acid according to the following reaction:

$$Ar—COOM\rightarrow Ar^{\bullet}+CO_2+e^{-}+M^{+}$$

wherein $Ar^{\bullet}$ is an aryl radical, and wherein $Ar^{\bullet}$ reacts with $R^{\bullet}$ to produce the aryl-alkyl compound (R—Ar).

24. The process for producing an aryl-alkyl (R—Ar) compound according to claim 20, wherein one or more alkyl-alkyl compounds are formed in addition to the aryl-alkyl compound.

25. The process for producing an aryl-alkyl (R—Ar) compound according to claim 20, wherein one or more aryl-aryl compounds are formed in addition to the aryl-alkyl compound.

26. The process for producing an aryl-alkyl (R—Ar) compound according to claim 20, wherein the alkali metal is sodium.

* * * * *